US008235586B2

(12) United States Patent
Li et al.

(10) Patent No.: US 8,235,586 B2
(45) Date of Patent: Aug. 7, 2012

(54) SMART CARD WATCH

(75) Inventors: Chen Li, Zhuhai (CN); Lucas Alexander Karl Scheybal, Vienna (AT)

(73) Assignee: LAKS GmbH, Vienna (AT)

( * ) Notice: Subject to any disclaimer, the term of this patent is extended or adjusted under 35 U.S.C. 154(b) by 109 days.

(21) Appl. No.: 12/736,307

(22) PCT Filed: Mar. 25, 2009

(86) PCT No.: PCT/EP2009/053515

§ 371 (c)(1),
(2), (4) Date: Sep. 28, 2010

(87) PCT Pub. No.: WO2009/121771

PCT Pub. Date: Oct. 8, 2009

(65) Prior Publication Data

US 2011/0013490 A1 Jan. 20, 2011

(30) Foreign Application Priority Data

Mar. 29, 2008 (CN) ..... 2008 2 0045860 U

(51) Int. Cl.
*G04B 37/00* (2006.01)

(52) U.S. Cl. ..... 368/291; 368/13

(58) Field of Classification Search ..... 368/13, 368/291–292, 309

See application file for complete search history.

(56) References Cited

U.S. PATENT DOCUMENTS

| | | | | |
|---|---|---|---|---|
| 4,690,567 | A | 9/1987 | Rebeaud | |
| 6,200,018 | B1 * | 3/2001 | Dubugnon et al. | 368/281 |
| 6,224,254 | B1 * | 5/2001 | Hayek et al. | 368/281 |
| 6,646,957 | B2 * | 11/2003 | Martin et al. | 368/10 |
| 7,800,982 | B2 * | 9/2010 | Marhic et al. | 368/10 |
| 8,050,716 | B2 * | 11/2011 | Shin et al. | 455/558 |
| 8,059,491 | B1 * | 11/2011 | Hennings-Kampa | 368/14 |
| 2003/0103413 | A1 * | 6/2003 | Jacobi et al. | 368/10 |
| 2004/0151071 | A1 * | 8/2004 | Kocher | 368/10 |
| 2006/0146650 | A1 * | 7/2006 | Dinger | 368/13 |
| 2008/0089182 | A1 * | 4/2008 | Scheybal | 368/10 |
| 2009/0231960 | A1 * | 9/2009 | Hutcheson | 368/10 |

FOREIGN PATENT DOCUMENTS

| | | |
|---|---|---|
| DE | 298 09 862 | 11/1998 |
| DE | 198 26 428 | 12/1999 |
| DE | 199 54 821 | 5/2001 |
| DE | 201 11 408 | 9/2001 |

* cited by examiner

*Primary Examiner* — Sean Kayes
(74) *Attorney, Agent, or Firm* — Collard & Roe, P.C.

(57) ABSTRACT

A smart card watch comprises a watch head (1) and straps (2). A timepiece device and a smart card device are provided in the watch head (1), and a card slot (126) is provided on the side of the watch head (1). People can easily carry the smart card (153) with the watch which cannot be lost easily and they can conveniently change smart cards having different functions any time and anywhere they want. The smart card has great functions and can be used and operated easily. Furthermore, the timepiece device and the smart card device are installed in separate sealed chambers, a first chamber (14) and a second chamber (15) in the watch head (1), thus the timepiece device can be well protected such that it has a prolonged endurance and an ensured working stability. Even if the back-cover (13) is opened to repair the smart card device, the normal operation of the timepiece device and the water-tightness of the first chamber (14) are not affected. Besides, the watch head (1) is further provided with a port (154), in particular USB port, which can get access to the service provider's websites via an external computer for electronic data communication and data updates of related services.

9 Claims, 2 Drawing Sheets

SMART CARD WATCH

CROSS REFERENCE TO RELATED APPLICATIONS

This application is the National Stage of PCT/EP2009/053515 filed on Mar. 25, 2009, which claims priority under 35 U.S.C. §119 of Chinese Application No. 200820045860.7 filed on Mar. 29, 2008, the disclosure of which is incorporated by reference. The international application under PCT article 21(2) was published in English.

TECHNICAL FIELD

The present invention is related to a watch, in particular, a watch with a smart card.

BACKGROUND OF THE INVENTION

With the rapid development of integrated circuit technology, the application of contactless IC card or smart card is becoming more and more widespread, which, in turn, makes data communication more convenient. For example, if a person carries a con-tactless IC card with an induction coil with him, he can conveniently communicate with certain external sensing terminals for ID identification and confirmation, electronic data communication or E-money use on the bus, in the subway, banks, hospitals or membership clubs. However, IC card is easy to get lost, and is not convenient to carry. To solve this problem, some manufacturers have already manufactured watches with smart cards. Some has the smart card soldered on the printed circuit board (PCB board), which has solved the carriage problem, but the function of the watch is limited to the service functions of the smart card soldered inside it in the factory whose function is simple and cannot be repaired conveniently. While some manufactures install the smart card into the watch from the backcover, thus smart cards can be easily replaced.

SUMMARY OF THE INVENTION

The object of the present invention is to provide a watch with a smart card which allows the smart cards to be changed easily.

The object of the present invention is achieved by the following technical solutions:

A smart card watch includes a watch head and straps. A timepiece device and a smart card device are provided in the watch head, and a card slot is provided on the side of the watch head.

The smart card device includes a PCB board, a card socket and a smart card in flexible connection with the card socket, and the card socket is soldered on the PCB board.

The position of the card slot corresponds to that of the card slot of the card socket, and the shape and size of the card slot matches those of the smart card.

The watch head has a cover connected to the card slot, and the cover can be a hard cover made of ABS plastic, and one end of the cover is connected with the watch head by a pin. The cover can also be a soft cover made of PU plastic, with one end fixed to the watch head.

The watch head has two separate chambers, a first chamber and a second chamber provided therein. The first chamber is provided with the timepiece device therein, and the second chamber is provided with the smart card device therein.

The watch head includes a glass lens, a watch case and a backcover. The glass lens is fixed on the front side of watch case by ultrasonic, and the backcover is screwed on the back side of watch case. A ring-shaped clapboard is provided in the watch case, whose outside edge is integrally connected with the watch case, and whose center extends downward to form a bulge, and an inner backcover is screwed to the bulge, thus dividing the chamber into the first chamber and the second chamber.

A water-resistant O-ring is further provided around where the inner backcover and the bulge are engaged.

An induction coil is further provided in the first chamber, which connects with the smart card device in the second chamber by a connecting pin going through the ring-shaped clapboard.

A water-resistant O-ring is provided around where the connecting pin goes through the ring-shaped clapboard, and one end of the connecting pin is connected with the induction coil by a conductive spring, and the other end is connected with the PCB board of the smart card device also by a conductive spring.

The first chamber further includes a movement, a dial and a dialring provided therein. The movement is held by a movement holder in a hollow formed by the ring-shaped clapboard and the inner backcover. The dial is located over the movement. The dialring is pressed onto a brim of the dial. The induction coil is provided in the dialring.

The watch case, the backcover, the inner backcover, the dial and the dialring are all made of plastic.

The watch is further provided with a port, in particular a USB port, for connecting with external devices, and the port, in particular the USB port, extends beyond the watch head from a gap provided in the watch case.

The advantageous effects of the invention lie in: a card socket and a smart card are mounted on the PCB board in the watch head such that people can easily carry the smart card with the watch which cannot easily get lost. A card slot is provided on the side of the watch head such that a user can conveniently change smart cards having different functions or issued by different issuers any time and anywhere according to his needs without changing watches having different functions or removing the backcover to replace the smart card, and thus the watch has great functions and can be used and operated easily. Since the timepiece device and the smart card device are installed in separate sealed chambers, the first chamber and the second chamber in the watch head, the timepiece device can be well protected such that it has a prolonged endurance and an ensured working stability. Even if the backcover is opened to repair the smart card device in the second chamber, the normal operation of the timepiece device and the water-tightness of the first chamber are not affected. Besides, the watch head is further provided with a port, in particular a USB port, which can get access to the service provider's websites via an external computer for electronic data communication and data updates of related services.

DETAILED DESCRIPTION

The present invention is further described with reference to the drawings and the detailed embodiments.

Figure 1:
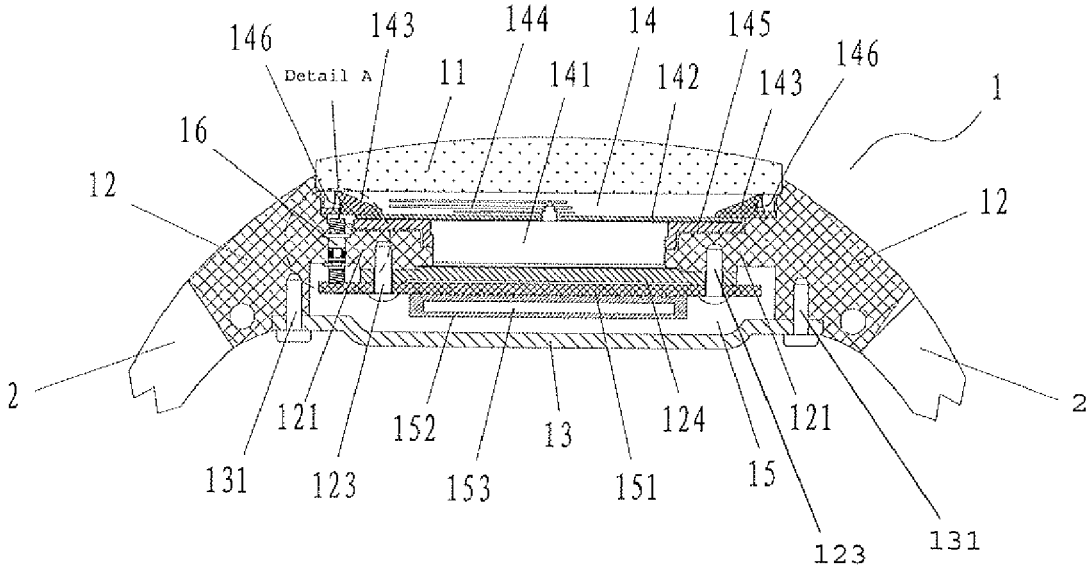
FIG. 1 diagrammatically shows a longitudinal section view of the structure of the watch head of the smart card watch of the present invention.
Figure 2:
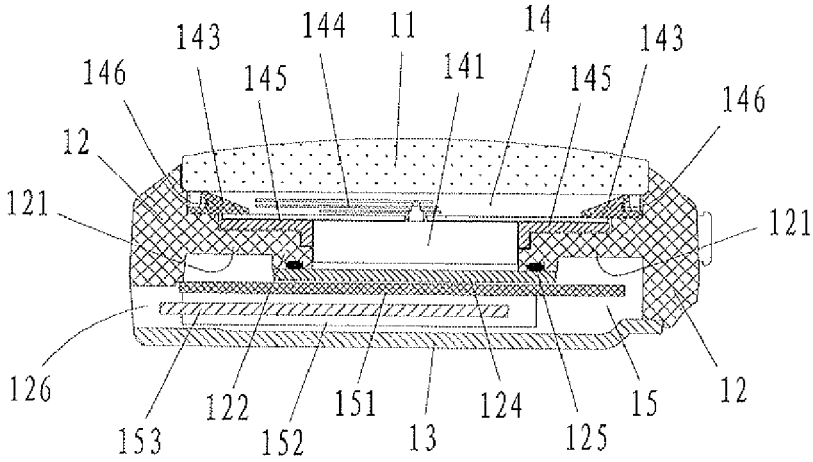
FIG. 2 diagrammatically shows a horizontal section view of the structure of the watch head of the smart card watch of the present invention.

As shown in FIGS. 1 and 2, the smart card watch of the present invention comprises a watch head 1 and straps 2. The watch head 1 comprises a glass lens 11, a hollow watch case 12 and a backcover 13. The glass lens 11 is fixed on the front side of the watch case 12 by ultrasonic. The watch case 12 and the backcover 13 are both made of plastic. The backcover 13 is screwed on the backside of the watch case 12 by bolts 131. A ring-shaped clapboard 121 is provided on the inner side wall of the watch case 12, whose outside edge is integrally connected with the watch case 12, and whose center extends downward to form a bulge 122. An inner backcover 124 which is made of plastic is screwed on the bottom of the bulge 122 by bolts 123. A water-resistant O-ring 125 is provided around where the backcover 124 and the bulge 122 are engaged by means of a hollow. The ring-shaped clapboard 121 and the inner backcover 124 divide the watch head 1 into a first chamber 14 and a second chamber 15. The first chamber 14 is a water-resistant and dust-resistant sealed chamber. A movement 141 with battery (i.e. module movement), a dial 142, a dialring 143 and watch hands 144 are provided in the first chamber 14. The movement 141 is held by a movement holder 145 into the hollow formed by the ring-shaped clapboard 121 and the inner backcover 124. The dial 142 is made of PE material, and is fixed on the upper surface of the ring-shaped clapboard 121. The dialring 143 is made of plastic, and is pressed on the brim of the dial 142. An induction coil 146 for receiving electronic data from external sensing terminals is further provided in the dialring 143. The watch hands 144 are installed on the pin of the movement which goes through the dial 142 such that the timepiece device in the sealed first chamber 14 can be well protected, and its endurance, prolonged and its working stability, ensured. A PCB board 151, a card socket 152, and a smart card 153 in flexible connection with the card socket 152 are provided in the second chamber 15. The card socket 152 is soldered on the PCB board 151. The PCB board 151 is fixed on the bottom of the inner backcover 124 by the bolt 123 (i.e. the bolt by which the inner backcover 124 is fixed on the ring-shaped clapboard 121). The shape and structure of the smart card 153 are similar to those of the SIM card of the existing mobile phones. Like the conventional smart cards, this smart card has a smart control chip sealed inside its plastic plate. The smart control chip includes a microprocessor, a storage, an encrypting device and an I/O port. The smart card 153 is installed in the card socket 152. A card slot 126 is provided on the side of the watch case 12, and the position of the card slot 126 corresponds to that of the card slot of the card socket 152, and the shape and size of the card slot match those of the smart card 153. This structure allows people to conveniently insert and use different smart cards (such as bus card, sub-way card, bank card, medical-insurance card, etc.) issued by different service providers according to their needs. When the backcover 13 of the watch is opened to repair the smart card device in the second chamber 15, it will not affect the normal operation of the timepiece device provided in the first chamber 14, or the water-tightness of the first chamber 14, and thus it has water-resistance and dust-resistance function such that the timepiece device is well protected and has a prolonged endurance and an ensured working stability. A connecting pin 16 is further provided in the watch head 1, which goes through the ring-shaped clapboard 121 and connects the induction coil 146 in the first chamber 14 and connects with the PCB board 151 in the second chamber 15. When people use the watch for money recharging, consumption or data updates, the induction coil 146 of the watch receives electronic data from external sensing terminals. The data travels through the connecting pin 16, the PCB board 151, the card socket 152 and the smart card 153 in sequence, and finally reaches the smart control chip provided in the smart card 153 for data processing and storage. After that, data will be fed back to the terminal in reverse to finish money-recharging, consumption and data-updates, etc.

Figure 3:
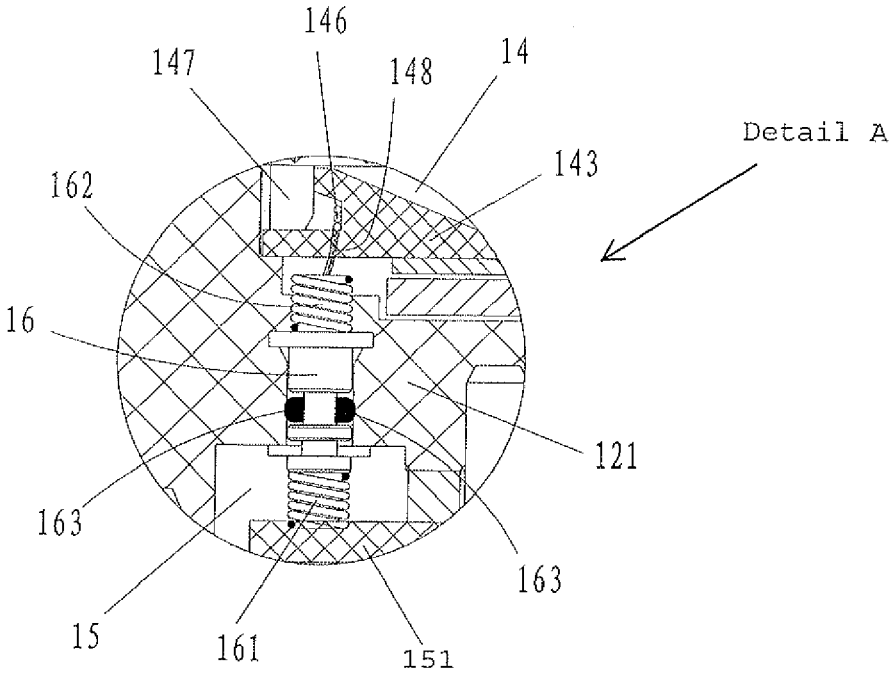
FIG. 3 diagrammatically shows a view of the structure of de-tail. A of the watch head of the smart card watch of the present invention according to FIG. 1.

As shown in FIG. 3, a dialring 143 is provided in the first chamber 14 of the watch head 1 of the smart card watch. An induction coil 146 made of brass and sealing glue 147 are installed in the dialring 143. A PCB board 151 is provided in the second chamber 15 (a card socket 152 is welded on the PCB board 151, not shown). A ring-shaped clapboard 121 and a connecting pin 16 are further provided in the watch head 1. The conductive connecting pin 16 goes through the ring-shaped clapboard 121, and connects with down-lead 148 of the induction coil 146 by a conductive spring 161 on one end, and connects with the PCB board 151 by another conductive spring 162 on the other end. A water-resistant O-ring 163 is provided around where the connecting pin 16 goes through the ring-shaped clapboard 121, thus the air-tightness of the first chamber 14 is not affected and the water-resistance and the dust-resistance are improved.

Figure 4:
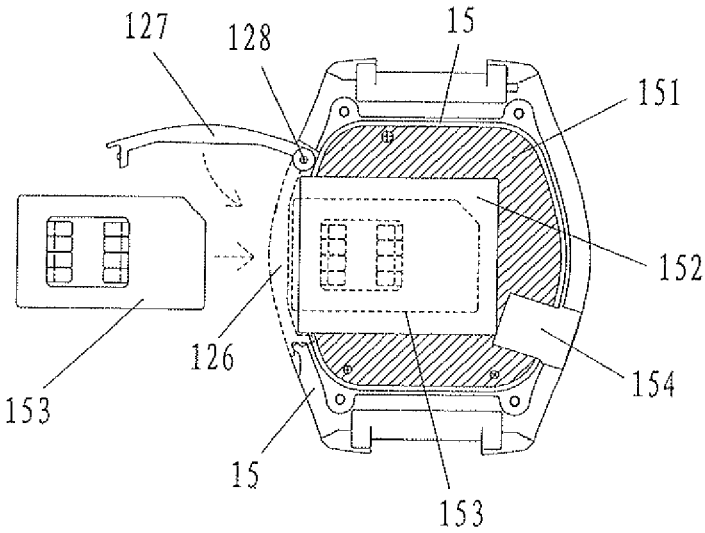
FIG. 4 shows the principle of operation of inserting the smart card into the smart card watch of the present invention.

As shown in FIG. 4, after opening the backcover 13 (not shown) of the smart card watch, the card socket 152 and port 154 soldered on the PCB board 151 can be seen in the second chamber 15 of the watch head 1. A card slot 126 is provided opposite the watch case 12 in the card socket 152. The user can conveniently insert, pull out and change smart cards having different functions into or from the card slot 126. The port 154 is a USB port extending beyond the watch head 1 from a gap provided in the watch case 12. The user can connect the USB port 154 of the watch to external devices, such as a computer by cables to get access to the websites of e-banks, membership clubs or subway company for money-recharge, consumption and data updates. The electronic data will travel through the USB port, the PCB board 151, the card socket 152 in sequence and finally reach the smart control chip of the smart card 153 for data-processing and storage. Then the electronic data will be fed back to the websites to finish on-line money-recharge, consumption and data-updates. A cover 127 engaged with the card slot 126 is provided on the side of the watch case 12. The cover 127 can be a hard cover made of ABS plastic, with one end connected with the watch case 12 by a pin 128. The cover 127 can also be a soft cover made of PU plastic, with one end fixed to the watch case 12.

The smart card watch of the present utility model can also be a digital watch (i.e. figure-jumping watch), with timepiece devices, such as an LCD display, a time control chip, a PCB board, a battery (button cell battery), etc. provided in the first chamber.

The invention claimed is:

1. A smart card watch, comprising a watch head and straps, wherein a timepiece device and a smart card device are provided in the watch head, and a card slot is further provided on a side of the watch head;

wherein the smart card device includes a PCB board, a card socket and a smart card in flexible connection with the card socket, and the card socket is soldered on the PCB board;

wherein the watch head is further provided with a cover connecting to the card slot;

wherein the watch head has two separate chambers, a first chamber and a second chamber provided in the watch head, and the timepiece device is provided in the first chamber, and the smart card device is provided in the second chamber;

wherein the watch head includes a glass lens, a watch case and a backcover, and the glass lens is fixed on the front side of the watch case by ultrasonic, and the backcover is screwed on the back side of the watch case, a ring-shaped clapboard is provided in the watch case, whose outside edge is integrally connected with the watch case and whose center extends downward to form a bulge, and an inner backcover is further screwed to the bottom of the bulge, thus dividing the chamber into the first chamber and the second chamber; and wherein a water-resistant O-ring is provided around where the inner backcover and the bulge are engaged.

2. A smart card watch according to claim 1, wherein a position of the card slot corresponds to that of the card slot of the card socket, and the shape and size of the card slot matches those of a smart card.

3. A smart card watch according to claim 1, wherein the cover is a hard cover made of ABS plastic, whose one end is connected with the watch head by a pin.

4. A smart card watch according to claim 1, wherein the cover is a soft cover made of PU plastic, with one end fixed to the watch head.

5. A smart card watch according to claim 1, wherein an induction coil is provided in the first chamber, which is connected with the smart card device in the second chamber by a connecting pin which goes through the ring-shaped clapboard.

6. A smart card watch according to claim 5, wherein a water-resistant O-ring is provided around where the connecting pin goes through the ring-shaped clapboard, and one end of the connecting pin is connected with the induction coil by a conductive spring, while the other end is connected with the PCB board of the smart card device by another conductive spring.

7. A smart card watch according to claim 5, wherein a movement, a dial and a dialring are further provided in the first chamber, and the movement is held by a movement holder in a hollow formed by the ring-shaped clapboard and the inner backcover, the dial is provided over the movement, and the dialring is pressed on a brim of the dial, and the induction coil is provided in the dialring.

8. A smart card watch according to claim 1, wherein the watch case, the backcover, the inner backcover, the dial and the dialring are all made of plastic.

9. A smart card watch according to claim 1, wherein the watch is further provided with a port, in particular USB port, for connecting with external devices, and the port, in particular USB port, extends beyond the watch head from a gap provided in the watch case.

* * * * *